United States Patent [19]

Kemmerling

[11] Patent Number: 5,014,531

[45] Date of Patent: May 14, 1991

[54] METHOD FOR AUTOMATICALLY REDUCING THE DRAWING SPEED OF A TUBULAR MATERIAL DRAWING MACHINE

[75] Inventor: Karl-Heinz Kemmerling, Mönchengladbach, Fed. Rep. of Germany

[73] Assignee: Mannesmann Aktiengesellschaft, Düsseldorf, Fed. Rep. of Germany

[21] Appl. No.: 500,041

[22] Filed: Mar. 27, 1990

[51] Int. Cl.[5] ..... B21C 1/12

[52] U.S. Cl. ..... 72/9; 72/288; 72/279

[58] Field of Search ..... 72/288, 279, 14, 9, 72/12; 226/42, 29

[56] References Cited

U.S. PATENT DOCUMENTS

| | | | |
|---|---|---|---|
| 3,539,085 | 11/1970 | Anderson | 226/42 |
| 3,593,558 | 7/1971 | Sperduti | 72/289 |
| 3,798,939 | 3/1974 | Mertens | 72/288 |
| 4,890,470 | 1/1990 | Gerretz et al. | 72/289 |

*Primary Examiner*—Daniel C. Crane

*Attorney, Agent, or Firm*—Nils H. Ljungman & Associates

[57] ABSTRACT

Method of automatically reducing the drawing speed of a tubular material drawing machine when the end of a coil of tubular material, being drawn through the machine, approaches.

9 Claims, 2 Drawing Sheets

METHOD FOR AUTOMATICALLY REDUCING THE DRAWING SPEED OF A TUBULAR MATERIAL DRAWING MACHINE

BACKGROUND OF THE INVENTION

1. Field of the Invention

This invention relates to a method for automatically reducing the drawing speed of a tubular material drawing block machine. The drawing block machine is employed for drawing tubular material, or similar items. The invention is employed to slow the speed of the machine before the end of drawing of a coil of tubular material. With this drawing process, each of several tubular material coils is drawn through a drawing die, in succession. The drawn tubular material is, then, collected in a collecting basket. The collecting basket is, then, transported to a pay-out station. The drawn tubular material is then re-drawn one or more times until the desired diameter and wall thickness, of the tubular material, is achieved.

2. Background Information

Initially, it is to be understood that, as recited in the specification and claims, the term "tubular material" may include rods, wire, and/or tubes, or the like.

Continuous drum drawing machines, for tubular material, are frequently known as drawing or spinner blocks. One example of such a machine may be found in U.S. Pat. No. 4,890,470, entitled "Loop Transport System For A Plurality Of Baskets Containing Material To Be Drawn Through A Drawing Machine." The drawing force of the drawing block, or drum, is supplied by the friction between the block and the tubular material since the tubular material is wrapped, generally, five to ten times around the drum and supported by non-driven idler rollers that press the tubular material against the exterior surface of the drum. As the tubular material accumulates on the drum, the uppermost portions of the tubular material exert a continuous downward pressure on the portions of the tubular material below so that the lower portions are discharged into a receiving basket.

The receiving basket is configured to an appropriate size so that the largest possible coil weight can be held to allow a long length of tubular material to be kept in a single, continuous length, even when the tubular material is drawn to extremely small dimensions.

Tubes are reduced in several passes. For example, a size 55×2.5 mm tubular material having a unit weight of 300 kg, may be reduced to size 6×0.35 mm for example. The resulting tubular material, in this example, is 5,450 m long. Such dimensions mean that the tubular material has an initial diameter of 55 mm and an initial wall thickness of 2.5 mm, while the final dimensions may be a diameter of 6 mm and a wall thickness of 0.35 mm.

After one pass through the machine, the receiving basket, loaded with drawn tubular material, is transported from its position underneath the drawing block, to a pay-out station. The tubular material is then guided back through the machine for another pass through the drawing die and around the drawing block, after a new, empty receiving basket is placed under the drawing block at the receiving station. Generally, six to seven coils of tubular material are processed as a group, in succession until all coils in the group have been finally reduced.

If only a few turns of tubular material remain in the basket at the pay-out station, the drawing speed, of the machine, must be reduced so that the end of the tubular material does not thrash back and forth, in an uncontrolled manner, when leaving the pay-out basket and, also, so that the end of the tubular material does not jump out of the basket. Also, jerk of the tubular material, which may occur when the tubular material is discharged from the drawing die and the friction between the tubular material and the drum disappears, is sharply decreased. The maximum attainable drawing speed is, currently, about 1,200 m/minute. A reduction of this drawing speed to approximately 60 m/min., at the end of the drawing pass, is desirable to prevent the above described problems.

In prior art machines, the reduction of the speed of rotation, when there are only a few number of turns of tubular material remaining in the pay-out basket, is performed by the operator, who observes the number of turns remaining in the pay-out basket by means of one or more mirrors. When there are only a few turns remaining in the basket, the operator activates a control to reduce the speed. The remaining turns are then drawn at the reduced speed, for the reasons indicated above. This activity occupies the operator during a portion of the drawing process so that he cannot do other work.

The need to automate the spinner block process, thereby freeing up the operator for other duties, has led to the idea of counting the turns of tubular material that fall into the receiving basket and storing that value in a computer with a memory counter. When the basket is again in the pay-out station, during the next drawing sequence, the falling turns are again recorded by the computer and the drawing speed is reduced when a certain number of turns have fallen into the basket. However, the computer must mathematically adjust the number of turns by the elongation which occurs during reduction of the tubular material in the drawing die. Another factor, for which a mathematical adjustment should be, but usually is not, made, includes fluctuating tubular material weight, per unit of length, which is a function of the condition of the drawing die. Different tubular material weights result in varying tubular material lengths and numbers of turns of tubular material after the drawing process. With a hypothetical weight fluctuation of plus/minus 5% and a nominal length of 5,000 m, the fluctuations would be plus/minus 250 m. If we take these possible errors into consideration, by programming the computer for the smallest possible number of turns of tubular material then, with the maximum tubular material length possible, an additional 500 m would be drawn at the reduced drawing speed. The average drawing speed is, thereby, severely decreased and the drawing time becomes correspondingly longer.

In another process of the prior art, after several turns of the tubular material are drawn, the tubular material is marked with a dye or paint. During the next pass, this marking is detected by sensors and used as a signal to reduce the speed of the drawing block drive. This process takes advantage of the fact that the beginning of the tubular material that falls into the receiving basket, first, becomes the end of the tubular material in the next pass. This process has not been implemented, in actual practice, because no suitable marking inks, dyes or paints exist, on the market, which guarantee the optical detection of the end segment of the tubular material.

OBJECT OF THE INVENTION

Because of the problems described above, one object of the present invention is to provide a method for the automatic reduction of the drawing speed of a tubular material drawing block, that can be easily activated by the operator during one pass of each drawing cycle that need not be changed any further during additional passes of the same drawing cycle.

This object is achieved by the present invention.

SUMMARY OF THE INVENTION

The present invention provides a process wherein the tubular material lengths, of each tubular material coil, are measured during the first pass of each coil through the drawing machine. The tubular material lengths are, then, compared to the elongation of the first tubular material coil after its second pass through the machine. The length of the first tubular material is designated as M1. Constants Q and D, that are calculated as described below, are used to determine the speed reduction points for the remaining tubular material of the drawing cycle, without the need for any further manual intervention.

The process may employ pulse counters. The pulse counters are employed to store the lengths, in the form of pulses, of all, typically seven, tubular material coils, before and after processing through the machine. The operator observes the pay-out basket, during the drawing of the first tubular material coil during the second pass through the machine and manually changes to low speed when there are only a few turns of tubular material left in the basket.

The length of the tubular material, from the beginning to the point of speed reduction, during the second pass, is designated as M2 and that length is converted into pulses and stored. The entire length of the tubular material is designated as M3 and is, also, converted to pulses and stored. Quotient Q, wherein $Q=M3 \div M1$, is used as an approximation for the elongation of the remaining tubular material during their second pass through the machine. Also taken into consideration are the current diameters of the drawing die and plug, which also have an effect on the length of the finished tubular material.

M2 is then subtracted from M3. This difference is designated as D. D represents an approximation for the length of tubular material that must be run at a reduced drawing speed. With constants Q and D determined in this manner, the changeover point can be calculated for the, typically 6, remaining tubular material coils of the drawing cycle, as described below. The pulse number, corresponding to the new total tubular material length, is stored for a determination of the subsequent speed changeover points. When a tubular material tear occurs, the automatic changeover is disabled and the changeover to low speed is manually performed.

One aspect of the invention resides broadly in a method of shaping tubular material that includes the steps of providing first tubular material having a first end and a second end, providing second tubular material having a third end and a fourth end, providing tubular material shaping apparatus configured to draw the first and second tubular material therethrough at a first speed and a second speed, providing a tubular material length sensor, and providing a first shaping of the first tubular material by drawing the first tubular material through the tubular material shaping apparatus. The method further includes the steps of measuring a first length of the first tubular material from the first end to the second end with the tubular material length sensor, providing a first shaping of the second tubular material by drawing the second tubular material through the tubular material shaping apparatus and measuring the length of the second tubular material with the tubular material length sensor device. Additional steps of the method include providing a second shaping of the first tubular material by drawing the first tubular material through the tubular material shaping apparatus at the first speed from the first end to a first intermediate location of the first tubular material and drawing the first tubular material through the tubular material shaping apparatus at the second speed from the first intermediate location to the second end. Further steps of the method include measuring a second length of the first tubular material from the first end to the first intermediate location with the tubular material length sensor, measuring a third length of the first tubular material from the first end to the second end with tubular material length sensor, calculating a quotient by dividing the third length by the first length, and calculating a difference by subtracting the second length from the third length. Additional steps of the method include calculating a second intermediate location of the second tubular material by multiplying the length of the second tubular material by the quotient to form a product and subtracting the difference from the product. Further steps of the method include providing a second shaping of the second tubular material by drawing the second tubular material through the tubular material shaping means at the first speed from the third end to the second intermediate location, and drawing the second tubular material through the tubular material shaping apparatus at the second speed from the second intermediate location to the fourth end.

BRIEF DESCRIPTION OF THE DRAWINGS

The following Detailed Description of the Preferred Embodiment may be better understood when taken in conjunction with the appended drawings in which.

DESCRIPTION OF THE PREFERRED EMBODIMENT

Figure 1:
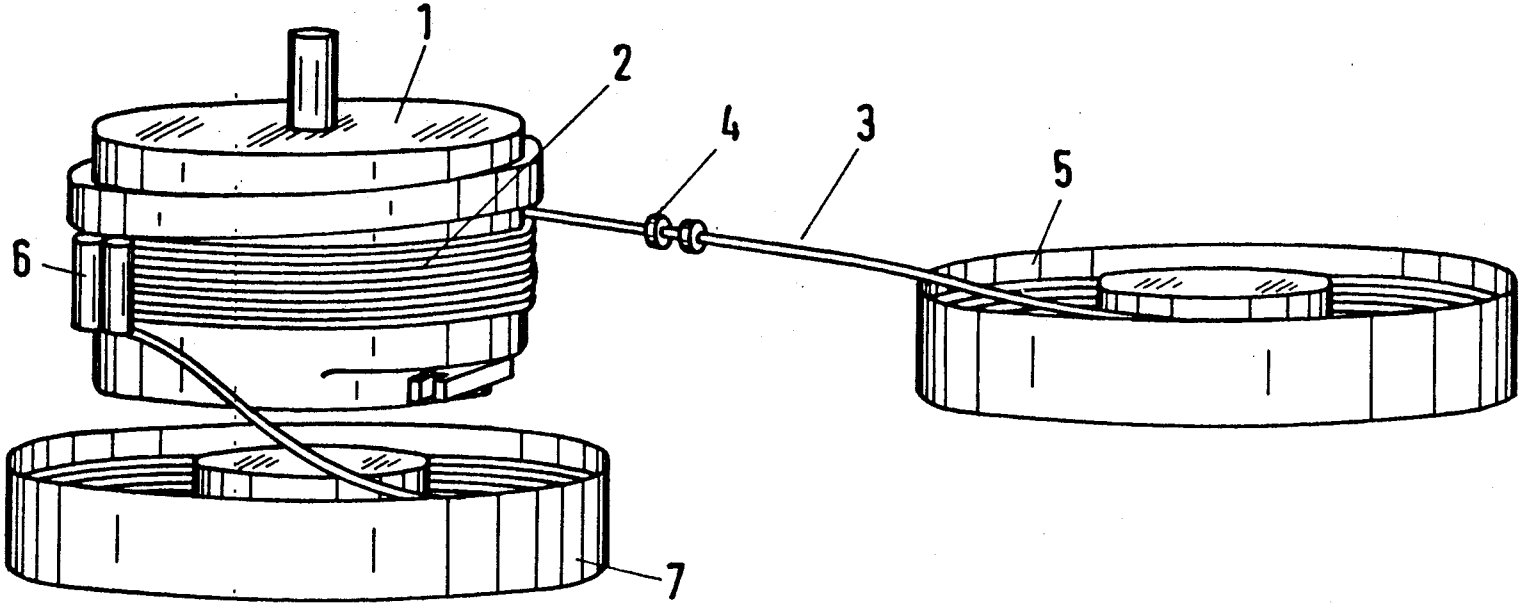
FIG. 1 is a perspective view of some of the functional parts of a tubular material drawing machine employing the present invention.

FIG. 1 shows drawing block 1 and the tubular material 2, which is coiled in a known manner over several rotations. A friction force is present between block 1 and tubular material 2, since tubular material 2 is tightly wrapped on block 1. The friction force makes it possible for tubular material portion 3 to be drawn and reduced through drawing die 4. During the drawing process, the tubular material, to be drawn, lies in pay-out basket 5. Pay-out basket 5 is positioned in a pay-out station (not shown). The reduced, drawn tubular material is discharged from drawing block 1 into receiving basket 7, which is located beneath it. The discharge occurs due to tubular material 2 pushing the tubular material, already on drawing block 1, downward, so that the latter falls down when it gets past the area of idler rollers 6.

As soon as receiving basket 7 is filled with a complete length of tubular material, e.g. 5,000 m, receiving basket 7 is moved to the pay-out station and, thus, becomes a new, pay-out basket 5. The empty pay-out basket 5 is placed under drawing block 1 and becomes the new receiving basket 7. The end of the drawn tubular material is introduced into the spinner block as the beginning of a new tubular material to be drawn in the next pass through the machine, so that a second drawing can take place in the same manner. Additional drawings may also be performed.

Figure 2:
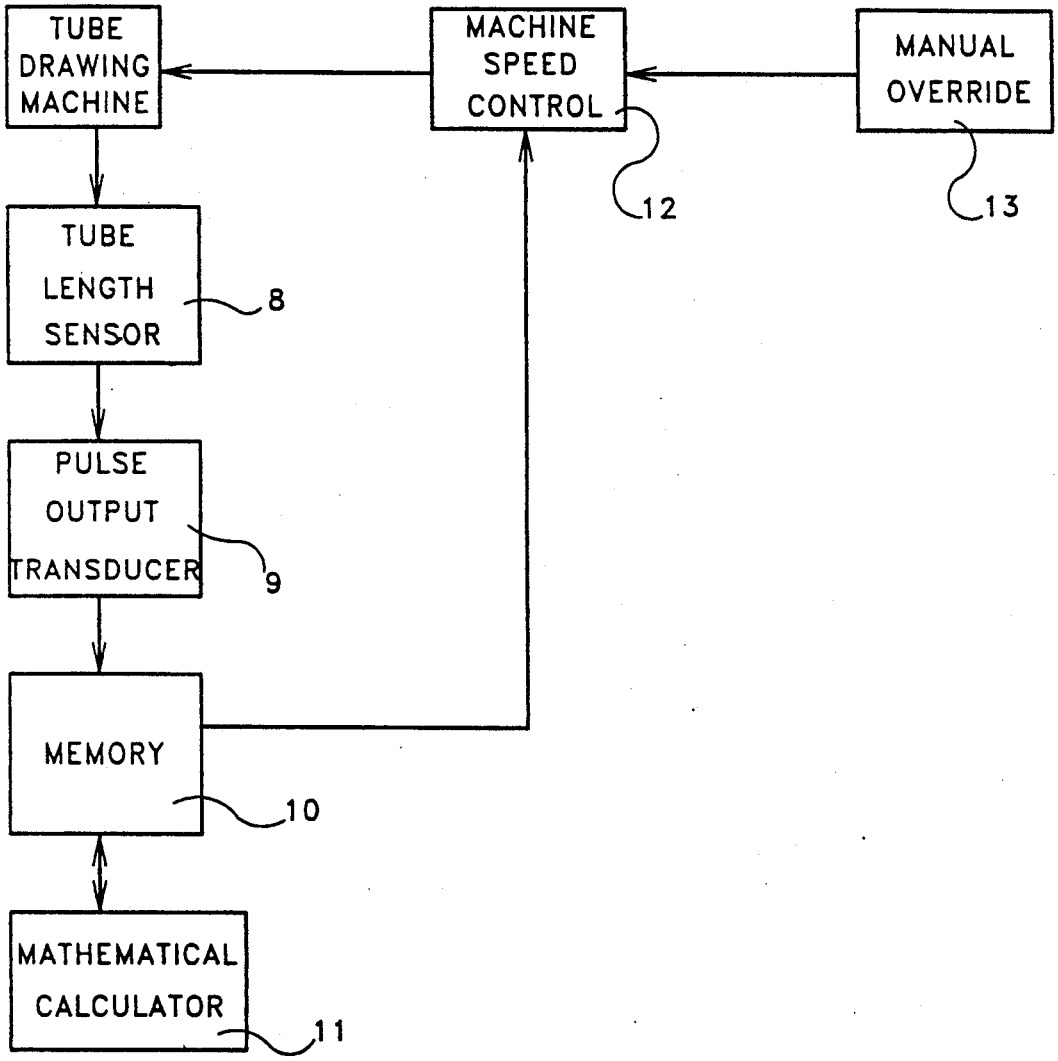
FIG. 2 is a block diagram of the components that perform the process of the present invention.

FIG. 2 shows, in block diagram form, the apparatus for automatically adjusting the speed of the tubular material through the machine. In one preferred embodiment of the invention, tubular material length sensor 8 measures the tubular material through drawing block 1, and supplies this data to pulse output transducer 9. Pulse output transducer 9 transmits one pulse per meter of tubular material to memory 10. For a tubular material length of 200 m after the first pass, therefore, 200 pulses would be stored in memory 10.

Mathematical calculator 11 calculates Q and D from M1, M2 and M3, as described above, and supplies memory 10 with the required data regarding the speed of drawing of the tubular material. Memory 10 then, supplies that data to machine speed control 12 which, in turn, controls the tubular material drawing machine.

As an example, a first coil tubular material is measured to be 286 m long after the second pass and, therefore, 286 pulses would be stored in memory 10.

To get the end of the tubular material to go through drawing die 4 slowly, after 250 m or 250 pulses, the operator switches the machine to slow speed with manual override 13. Thirty six pulses will then be registered until the end of drawing. These 36 pulses correspond to the tubular material length of 36 meters, which is run at a reduced speed.

If now, for example, another basket has a coil of tubular material that is 300 m long, after the first pass, the tubular material length, LA, at which the changeover to low speed must take place is calculated as follows:

$M1=200$
$M2=250$
$M3=286$
$Q=286\div200=1.43$
$D=286-250=36$
$LA=300\times1.43-36=393$ In the above example, accordingly, the machine would have to be switched to slow drawing speed after 393 pulses, corresponding to 393 meters.

To determine the new drawn lengths, the number of pulses from the start of drawing to the end of drawing is counted and stored: this value is used as the basis for the calculation in the next drawing cycle.

In summary, one feature of the invention resides broadly in a process for the automatic reduction of the drawing speed of drawing blocks for tubular material or similar items before the end of drawing of a tubular material coil, whereby after a pass through the drawing die, each of several tubular material coils drawn one after the other is collected in a receiving basket, which is transported gradually after the drawing of the tubular material coil into a pay-out station, whence it is introduced to an additional series of drawing processes executed in the same sequence, characterized by the fact that the length of the drawn tubular material of each tubular material coil in the cycle is measured (M1) and recorded, that during the second pass of the first tubular material coil, the drawing speed is manually reduced toward the end of the drawing, and the length of the tubular material drawn up to the time the speed is reduced is measured (M2) and recorded, that the total length of the tubular material is measured (M3) and recorded after the second drawing, that the quotient: $Q=M3/M1$ is formed from the third measurement (M3) and the first measurement (M1), and the difference $D=M3-M2$ is formed from the third measurement (M3) and the second measurement (M2) and that for the subsequent two passes of the following tubular material lengths R, the drawing speeds are reduced after the passage of the length of the drawn tubular material LA according to the following formula: $LA=R\times Q-D$.

Some examples of drawing processes can be found in U.S. Pat. No. 4,879,892, entitled "Drawing Machine For Continuous Drawing Of Endless Wires Or Tubes"; U.S. Pat. No. 4,860,568, entitled "Tubular Material Drawing Apparatus For Manufacturing Precision Tube"; U.S. Pat. No. 4,854,148, entitled "Cold Drawing Technique And Apparatus For Forming Internally Grooved Tubes"; U.S. Pat. No. 4,800,048, entitled "Die Drawing Process And Apparatus For Piezoelectric Polymer Films And Tubes"; U.S. Pat. No. 4,748,835, entitled "Plug Drawing Of Tubes And Other Hollow Items"; U.S. Pat. No. 4,726,211, entitled "Method of Cold Drawing Seamless Metal Tubes Each Having An Upset Portion On Each End"; U.S. Pat. No. 4,697,447, entitled "Plug Drawing Of Tubes And Other Hollow Items"; U.S. Pat. No. 4,655,065, entitled "Plug Drawing Of Tubes And Other Hollow Items"; U.S. Pat. No. 4,606,212, entitled "Device For Cold Drawing Seamless Metal Tubes Having Upset Portions On Both Ends" and U.S. Pat. No. 4,522,052, entitled "Processes And Devices For The Drawing Of Tubes By Extrusion."

Some examples of devices to assist in performing calculations can be found in U.S. Pat. No. 4,650,996, entitled "Angle Transducer Employing Polarized Light"; U.S. Pat. No. 4,109,389, entitled "Shaft Angle Transducer"; U.S. Pat. No. 4,807,476, entitled "Variable Angle Transducer System And Apparatus For Pulse Echo Inspection Of Laminated Parts Through A Full Radial Arc"; U.S. Pat. No. 4,430,647, entitled "Monitor For Detecting Malfunction Of A Rotation-Angle Transducer"; U.S. Pat. No. 4,599,667, entitled "Automatic Azimuth Angle Adjustment Head Mounting Structure"; U.S. Pat. No. 4,825,690, entitled "Method Of Controlling A Dynamometer"; U.S. Pat. No. 4,687,410, entitled "Torque Limiter For Prime Mover"; U.S. Pat. No. 4,635,209, entitled "Overspeed Protection Control Arrangement For A Stream Turbine Generator Control System"; U.S. Pat. No. 4,550,283, entitled "Unipolar Rotational Speed Transducer"; U.S. Pat. No. 4,229,695, entitled "Rotational Speed Transducer Having Greater Low Speed Discrimination"; U.S. Pat. No. 4,896,051, entitled "Multi-Purpose Sense Controller"; U.S. Pat. No. 4,652,991, entitled "Data Transfer Apparatus"; U.S. Pat. No. 4,581,755, entitled "Voice Recognition System" and U.S. Pat. No. 4,764,875, entitled "Positive Yarn Feed."

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The details in the patents, patent applications, and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. Method of shaping tubular material comprising the steps of:

first shaping a first tubular material by drawing the first tubular material through a tubular material shaper;

measuring a first length of the first tubular material after said first shaping of the first tubular material from a first end to a second end first shaping a second tubular material by drawing the second tubular material through the tubular material shaper;

measuring the length of the second tubular material after said first shaping of the second tubular material from a third end to a fourth end;

second shaping the first tubular material by (a) drawing the first tubular material through the tubular material shaper at a first speed from the first end to a first intermediate location of the first tubular material, and (b) drawing the first tubular material through the tubular material shaper at a second speed from the first intermediate location to the second end;

measuring a second length of the first tubular material after said second shaping of the first tubular material from the first end to the first intermediate location;

measuring a third length of the first tubular material after said second shaping of the first tubular material from the first end to the second end;

calculating a quotient by dividing said third length by said first length;

calculating a difference by subtracting said second length from said third length;

calculating a product by multiplying said length of the second tubular material after said first shaping of the second tubular material by said quotient;

calculating an intermediate length by subtracting said difference from said product;

defining a second intermediate location being the location along the second tubular material separated from the third end by said intermediate length;

second shaping the second tubular material by: (a) drawing the second tubular material through the tubular material shaper at the first speed from the third end to the second intermediate location, and (b) drawing the second tubular material through the tubular material shaper at the second speed from the second intermediate location to the fourth end.

2. The method of claim 1, wherein the second speed is less than the first speed.

3. The method of claim 2, wherein the tubular material shaper includes drawing block means for drawing said first and second tubular materials.

4. The method of claim 3, wherein the tubular material shaper includes drawing die means for shaping the first and second tubular materials.

5. The method of claim 4, further including:

the tubular material shaper having idler roller means;

the idler roller means being adjacent said drawing block means; and the idler roller means guiding the first and second tubular materials through the tubular material shaper.

6. The method of claim 5, wherein the first tubular material and the second tubular material are measured by a length sensor.

7. The method of claim 6, wherein the length sensor comprises pulse generating means for converting each of said first, second and third lengths into a pulse signal.

8. The method of claim 6, wherein the length sensor converts said length of the second tubular material after said first shaping into a pulse signal.

9. The method of claim 8, wherein the tubular material shaper comprises manual speed control means for manually selecting the first speed and the second speed.

* * * * *